US011299884B2

(12) United States Patent
Stahl, Jr. et al.

(10) Patent No.: US 11,299,884 B2
(45) Date of Patent: Apr. 12, 2022

(54) FIRE-RESISTANT MULLION SEALER

(71) Applicant: Specified Technologies Inc., Somerville, NJ (US)

(72) Inventors: James P. Stahl, Jr., Princeton Junction, NJ (US); Paul J. Gandolfo, Doylestown, PA (US)

(73) Assignee: Specified Technologies Inc., Somerville, NJ (US)

( * ) Notice: Subject to any disclaimer, the term of this patent is extended or adjusted under 35 U.S.C. 154(b) by 0 days.

(21) Appl. No.: 16/791,017

(22) Filed: Feb. 14, 2020

(65) Prior Publication Data

US 2020/0263419 A1 Aug. 20, 2020

Related U.S. Application Data

(60) Provisional application No. 62/805,562, filed on Feb. 14, 2019.

(51) Int. Cl.
*E04B 1/94* (2006.01)
*E04B 2/96* (2006.01)

(52) U.S. Cl.
CPC ..... *E04B 1/947* (2013.01); *E04B 2/96* (2013.01)

(58) Field of Classification Search
CPC . E04B 1/947; E04B 2/96; E04B 2/967; E04B 1/943; E04B 1/944
See application file for complete search history.

(56) References Cited

U.S. PATENT DOCUMENTS 6,857,233 B2 * 2/2005 Farag ..... E04B 2/96 52/235
8,601,760 B2 * 12/2013 Hilburn, Jr. ..... E04B 1/947 52/232
9,206,596 B1 * 12/2015 Robinson ..... E04B 1/948

* cited by examiner

*Primary Examiner* — Patrick J Maestri
(74) *Attorney, Agent, or Firm* — Massina Pat. & TM Law PLLC

(57) ABSTRACT

A sealing plug configured for sealing a passage of a curtain wall mullion. The passage has a maximum width and a length. The sealing plug includes a main body extending from a first surface to a second surface. The main body has a width at least as large as the passage maximum width and a length at least as large as the passage length. The main body is manufactured from a compressible foam. An intumescent layer is defined along at least one of the first and second surfaces.

15 Claims, 3 Drawing Sheets

FIRE-RESISTANT MULLION SEALER

FIELD OF THE INVENTION

This invention relates to a fire-resistant sealing plug. More particularly, the invention relates to a fire-resistant sealing plug configured for positioning in the passage of a curtain wall mullion.

BACKGROUND OF THE INVENTION

A curtain wall is defined as thin, usually aluminum-framed wall, containing in-fills of glass, metal panels, or thin stone. The framing is attached to the building structure and does not carry the floor or roof loads of the building. The wind and gravity loads of the curtain wall are transferred to the building structure, typically at the floor line.

Curtain walls can be classified by their method of fabrication and installation into the following general categories: stick systems and unitized. In the stick system, the curtain wall frame (mullions) and glass or opaque panels are installed and connected together piece by piece. In the unitized system, the curtain wall is composed of large units that are assembled and glazed in the factory, shipped to the site and erected on the building. Vertical and horizontal mullions of the modules mate together with the adjoining modules. Modules are generally constructed one story tall and one module wide but may incorporate multiple modules.

Unitized curtain wall systems accommodate the differential movement between the structure and the thermal movement of the frame at the joints between each curtain wall unit. Because these units are frequently custom designed, the amount of movement to be accommodated can be carefully engineered into the system. Anchoring of unitized curtain wall typically consists of a proprietary assembly with three-way dimensional adjustability. The anchors occur at each pair of vertical mullions along the edge of slab or spandrel beam. Frequently, unitized systems span from a horizontal stack joint located at approximately desk height up to the anchor at the floor line above and then cantilevering past the floor to the next horizontal stack joint. The stack joint is designed to resist lateral loads while the two floor anchors resist gravity and lateral loads. One of the two floor anchors will allow movement in plane with the unitized system.

The stack joints sometimes have open mullions that create a path for smoke or sound to travel freely from floor-to-floor. In the field, sometimes these openings need to be sealed. However, as seen in FIGS. 1 and 2, the mullions 10, 10' may have various configurations with different types of expandable joints 12 and various projections 14 extending into the passage 16 of the mullion 10. Various methods have been attempted to seal the mullions 10, for example, stuffing insulation, caulking, or expandable foams, however, these methods have shortcomings.

SUMMARY OF THE INVENTION

In at least one embodiment, the present invention provides a sealing plug configured for sealing a passage of a curtain wall mullion. The passage has a maximum width and a length. The sealing plug includes a main body extending from a first surface to a second surface. The main body has a width at least as large as the passage maximum width and a length at least as large as the passage length. The main body is manufactured from a compressible foam. An intumescent layer is defined along at least one of the first and second surfaces.

In at least one embodiment, the main body width is larger than the passage maximum width and the main body length is larger than the passage length.

In at least one embodiment, the compressible foam is elastic.

In at least one embodiment, an intumescent layer is defined along both of the first and second surfaces.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
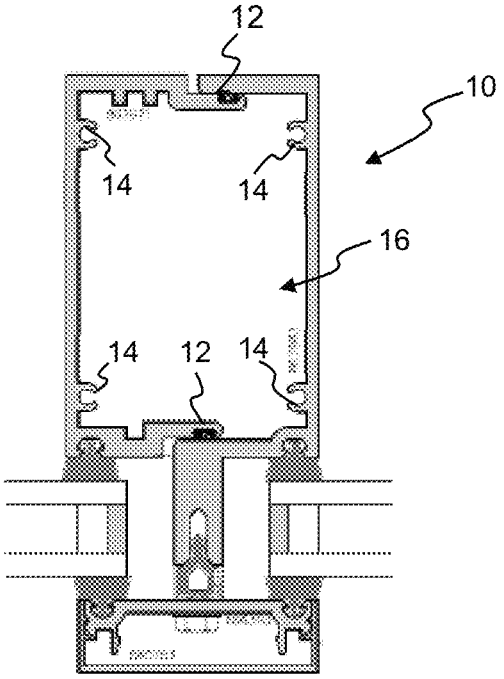
Fig. 1 (Prior Art)
FIGS. 1 and 2 are top plan views of illustrative curtain wall mullion configurations.
Figure 2:
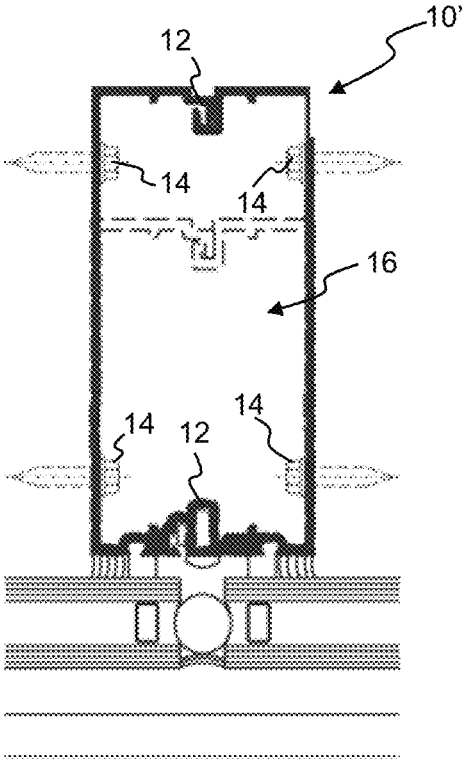
Fig. 2 (Prior Art)

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Figure 3:
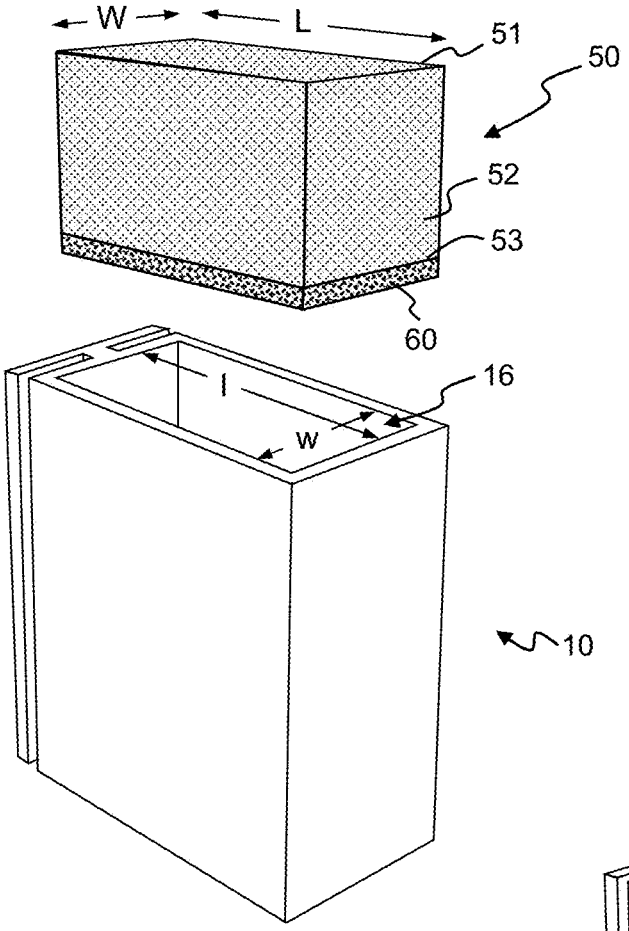
FIG. 3 is a perspective view of a sealing plug in accordance with an embodiment of the invention positioned prior to insertion in an illustrative mullion.
Figure 4:
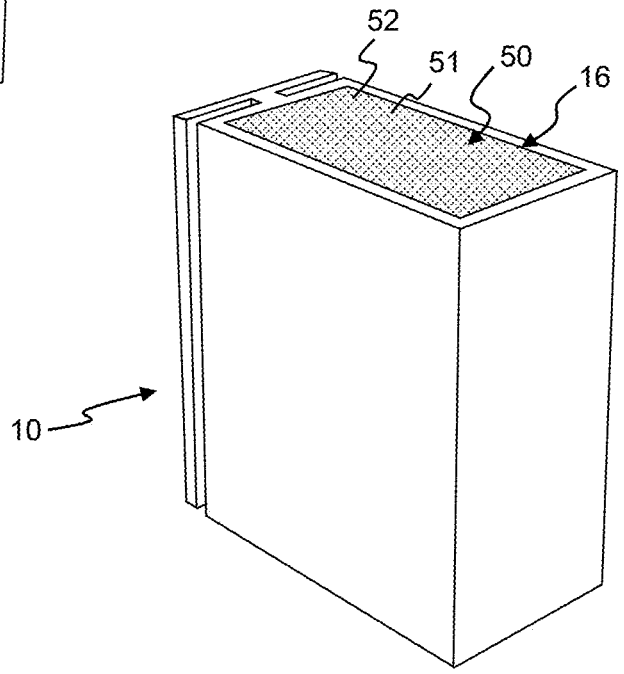
FIG. 4 is a perspective view of the sealing plug of FIG. 3 positioned within the passage of the illustrative mullion.

Referring to FIGS. 3 and 4, an exemplary embodiment of a sealing plug 50 in accordance with an embodiment of the invention will be described. The sealing plug 50 includes a main body 52 extending from a first surface 51 to a second surface 53. The main body 52 is manufactured from a compressible fire-retardant foam. The foam generally has an elasticity such that it returns to its original configuration when forces are removed therefrom. Exemplary foam materials include Pyrell®, available from FXI of Media, Pa., and S82ND2 polyester polyurethane foam, available from Wm. T. Burnett & Co. of Jessup, Md. These specific foams are provided as examples only and the invention is not limited to such.

The sealing plug 50 also includes a relatively thin layer of intumescent firestopping foam 60 applied to at least one of the surfaces 51, 53. The intumescent firestopping foam 60 is designed to expand rapidly responsive to fire and heat for the purpose of sealing off the passage 16. The intumescent foam 60 preferably includes a foam component chosen of one of various polymers such as polyurethane or silicone or any other polymer which has the capability of forming a soft resilient foam. The intumescent component of the foam may include expandable graphite, sodium silicate or any other commonly used expansion ingredient which is compatible for use with the basic foam carrier construction.

Figure 5:
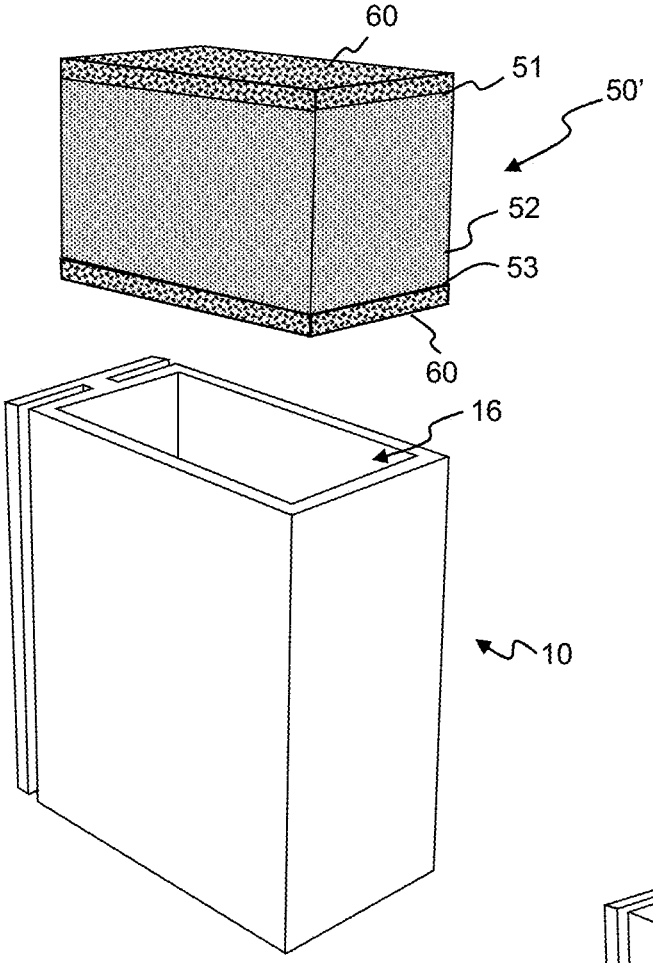
FIG. 5 is a perspective view of a sealing plug in accordance with another embodiment of the invention positioned prior to insertion in an illustrative mullion.
Figure 6:
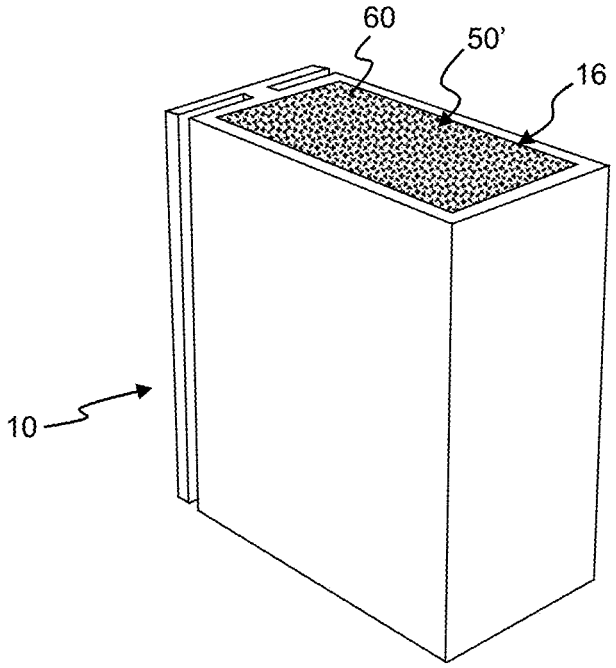
FIG. 6 is a perspective view of the sealing plug of FIG. 5 positioned within the passage of the illustrative mullion.

In the embodiment of the sealing plug 50 illustrated in FIG. 3, the intumescent foam 60 is only applied to one of the surfaces 53. The sealing plug 50 may be positioned in the mullion passage 16 with the intumescent foam 60 directed inward, as illustrated in FIG. 4, or the sealing plug 50 may be rotated 180° such that the intumescent foam 60 is directed outward (not shown). In the embodiment of the sealing plug 50' illustrated in FIG. 5, the intumescent foam 60 is applied to both of the surfaces 53. With this configuration, the intumescent foam 60 is directed both inward and outward, as shown in FIG. 6. It has been found that in addition to providing additional firestopping, the composite effect of the compressible foam body 52 and the intumescent foam 60 provides improved noise-reduction.

Referring to FIG. 3, the mullion passage 16 has a given width w and a given length 1. It is noted that the width w may be expandable to a maximum width. The sealing plug main body 52 has a width W which is at least as large, and preferably larger than, the maximum width w of the passage 16. Similarly, the main body 52 has a length L which is at least as large, and preferably larger than, the length 1 of the passage 16. With such a configuration, the sealing plug 50 is slightly compressed as it is positioned in the passage, thereby securing the plug 50 within the passage 16 and sealing relative thereto. The foam configuration of the main body 52 is ideal for conforming to irregularities or screws extending within the mullion passage.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A sealing plug configured for sealing a passage of a curtain wall mullion, the passage having a maximum width and a length, the sealing plug comprising:

a main body extending from a first surface to a second surface and having a width at least as large as the passage maximum width and a length at least as large as the passage length, the main body manufactured from a compressible foam; and an intumescent layer extending along at least one of the first and second surfaces, wherein the main body has a height and the intumescent layer height is significantly less than the height of the main body.

2. The sealing plug according to claim 1 wherein the main body width is larger than the passage maximum width and the main body length is larger than the passage length.

3. The sealing plug according to claim 1 wherein the compressible foam is elastic.

4. The sealing plug according to claim 1 wherein the compressible foam is manufactured from a fire-retardant material.

5. The sealing plug according to claim 1 wherein the intumescent layer is manufactured from a resilient foam.

6. The sealing plug according to claim 1 wherein an intumescent layer extends along both of the first and second surfaces.

7. A sealed mullion assembly comprising:

a curtain wall mullion defining a passage therethrough having a maximum width and a length; and a sealing plug positioned in the curtain wall mullion passage and comprising:

a main body extending from a first surface to a second surface and having a width at least as large as the passage maximum width and a length at least as large as the passage length, the main body manufactured from a compressible foam; and an intumescent layer extending along at least one of the first and second surfaces, wherein the main body has a height and the intumescent layer height is significantly less than the height of the main body.

8. The sealed mullion assembly according to claim 7 wherein the main body width is larger than the passage maximum width and the main body length is larger than the passage length.

9. The sealed mullion assembly according to claim 7 wherein the compressible foam is elastic.

10. The sealed mullion assembly according to claim 7 wherein the compressible foam is manufactured from a fire-retardant material.

11. The sealed mullion assembly according to claim 7 wherein the intumescent layer is manufactured from a resilient foam.

12. The sealed mullion assembly according to claim 7 wherein the passage has an open end and the sealing plug is positioned such that the intumescent layer faces toward the open end.

13. The sealed mullion assembly according to claim 7 wherein the passage has an open end and the sealing plug is positioned such that the intumescent layer faces away from the open end.

14. The sealed mullion assembly according to claim 7 wherein an intumescent layer is extends along both of the first and second surfaces.

15. The sealed mullion assembly according to claim 7 wherein the curtain wall mullion has an expandable width.

* * * * *